US006176014B1

(12) United States Patent
Garraway

(10) Patent No.: US 6,176,014 B1
(45) Date of Patent: Jan. 23, 2001

(54) SAFETY RAZORS

(75) Inventor: Richard Garraway, Guildford (GB)

(73) Assignee: The Gillette Company, Boston, MA (US)

( * ) Notice: Under 35 U.S.C. 154(b), the term of this patent shall be extended for 0 days.

(21) Appl. No.: 09/346,942

(22) Filed: Jul. 2, 1999

Related U.S. Application Data

(63) Continuation of application No. PCT/GB98/00006, filed on Jan. 2, 1998.

(30) Foreign Application Priority Data

Jan. 3, 1997 (GB) ..... 9700037

(51) Int. Cl.[7] ..... B26B 21/00

(52) U.S. Cl. ..... 30/32; 30/49; 30/50; 30/346.55; 30/346.56; 30/346.57

(58) Field of Search ..... 30/50, 32, 49, 30/346.55, 346.56, 346.57

(56) References Cited

U.S. PATENT DOCUMENTS

| | | | | |
|---|---|---|---|---|
| 1,269,299 | * | 6/1918 | Mergenthaler | 30/50 X |
| 1,493,788 | * | 5/1924 | Matthews | 30/50 X |
| 1,816,404 | * | 7/1931 | Schwarz | 30/50 X |
| 2,043,998 | | 6/1936 | Hadjopoulos . | |
| 2,119,405 | * | 5/1938 | Runcie | 30/50 X |
| 2,319,980 | * | 5/1943 | Des Jardins | 30/50 X |
| 4,443,939 | * | 4/1984 | Motta et al. | 30/49 |
| 4,603,477 | * | 8/1986 | Francis | 30/50 |

FOREIGN PATENT DOCUMENTS

| | | |
|---|---|---|
| 260090 | 10/1926 | (GB) . |
| 1259251 | 1/1972 | (GB) . |
| 1562857 | 3/1980 | (GB) . |
| 2119690 | 11/1983 | (GB) . |
| WO 85/02809 | 7/1985 | (WO) . |
| WO 95/29043 | 11/1995 | (WO) . |

* cited by examiner

*Primary Examiner*—M. Rachuba
(74) *Attorney, Agent, or Firm*—Charles P. Boukus, Jr.; Donal B. Tobin

(57) ABSTRACT

A novel cutting element in or for a safety razor comprises an elongate member with a series of slots (5), each slot (5) tapering from an open forward end to a substantially closed trailing end, and each slot (5) being confined between a pair of shaped edges (6) for slicing hairs as they move through the slot as the cutting element is moved across the skin. One or more of the cutting elements may be used in a safety razor blade unit, either alone or in combination with a blade having a conventional straight sharpened edge.

16 Claims, 3 Drawing Sheets

SAFETY RAZORS

This is a continuation of International Application No. PCT/GB98/00006, with an international filing date of Jan. 2, 1998.

This invention relates to safety razors, that is razors with cutting elements having sharpened edges which cut through the hairs due to the movement of the cutting element across the skin during shaving, and without the cutting element and another member being driven relative to each other to produce a shearing action. The invention is particularly concerned with a novel form of cutting element for a safety razor blade unit, and with a blade unit incorporating such a cutting element.

Safety razors generally comprise a blade unit with one or more cutting elements which are moved across the skin during shaving by means of a handle to which the blade unit is attached. A blade unit can be fixedly mounted on a handle with the intention that the entire razor be discarded when the cutting edges have become dulled, or the cutting element(s) can be replaceable in the blade unit. Alternatively, a blade unit can be detachably mounted on a handle for replacement when required. Replaceable blade units are commonly referred to as cartridges.

Most safety razors in current use have cutting members in the form of blades with rectilinear sharpened edges extending perpendicular to the direction in which the blades are intended to be moved over the skin in use. There is a tendency for a hair to be knocked over by a blade edge before the blade cuts through the hair, but effective cutting of the hair is obtained nonetheless as a result of the hair root being held firmly by the skin and the blade edge being located. closely adjacent the skin surface. It has been suggested to incline the blade edge to the direction of movement over the skin in order to produce more of a slicing cutting action, but such proposals have not gained acceptance due to increased risk of injury due to the blade cutting the skin.

The present invention resides in a new form of cutting element which represents a significant departure from the prior art practices. According to the invention there is provided a cutting element for a safety razor comprising slots tapering from open forward ends to substantially closed trailing ends, each slot being confined between a pair of edges at least one of which is sharpened for slicing hairs entering the slot and moving therealong towards the trailing end as the cutting element is moved across the skin during shaving.

With a cutting element according to the invention the sharpened edges can extend substantially in alignment with the direction of movement of the cutting element across the skin so that hairs are effectively sliced through, but the slots can be narrow enough to prevent skin from entering the slots so the risk of cutting the skin is no worse than with conventional razor blades, and it can even be reduced. A further benefit of the cutting element of the invention is that the sharpened edges need not scrape the skin surface in the same manner as conventional razor blades, and as a consequence less skin tissue will be removed during shaving. Furthermore, due to the hairs being cut through with a slicing action there may be an improved post-shave comfort as the cut end faces of the hairs will be more perpendicular to the length of the hairs and parallel to the skin than in the case of hairs cut with conventional blades which tend to knock the hairs over and cut them along planes at a shallow angle to the hair lengths thereby leaving pointed ends to the cut hairs.

In the preferred embodiments of a cutting element according to the invention, both edges of each slot are sharpened for enhanced hair slicing efficiency. The angle of taper, i.e. the angle between the opposed edges of a slot is suitably not greater than 10° and an angle of taper in the range of 3° to 7° is appropriate. The length of the cutting edges measured along the slots need not be great and effective slicing of hairs can be achieved with a length in the range of 1 to 2.5 mm. The width of the slots at the forward end of the sharpened edges is in the range of 50 to 500 $\mu$m.

Most conveniently the cutting element is elongated with a series of parallel slots distributed along the element to extend substantially perpendicular to the length of the element, the slots being preferably positioned at a pitch in the range of 0.5 to 2.0 mm.

The invention includes within its ambit a safety razor equipped with a cutting element in accordance with the invention, and a safety razor blade unit with a cutting element according to the invention. Two or more such cutting elements would be included in a blade unit to be moved over the skin in turn, the slots of all the cutting elements being directed in the same forward direction.

In addition a cutting element according to the invention could be utilised in a blade unit in combination with a conventional blade having a rectilinear sharpened edge, and the cutting element could be located in front of or behind the edge of the conventional blade with its slots substantially perpendicular to the length of the blade edge.

Another embodiment of a blade unit includes two cutting elements according to the invention arranged back-to-back to enable the blade unit to shave in two directions. Furthermore, several cutting elements could be utilised in a pad type razor with their slots oriented in different directions so that hairs will be shaved when the razor head including the cutting elements is rubbed over the skin surface moving in various directions.

To assist a clear understanding of the invention a more detailed description of some embodiment is given below, reference being made to the accompanying drawings, in which.

Figure 1:
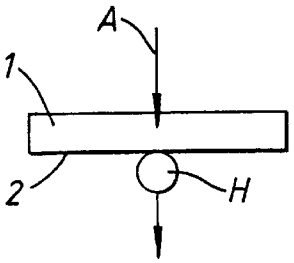
FIG. 1 is a schematic illustration showing the cutting action of a conventional razor blade.
Figure 2:
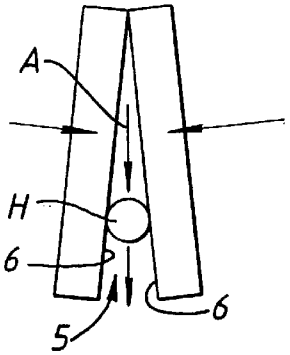
FIG. 2 is a corresponding schematic illustration showing the slicing action obtained with a cutting element embodying the invention.

With reference to FIG. 1, a conventional razor blade 1 with a rectilinear sharpened edge 2 is shown approaching a hair H in the direction of the arrow A, that is perpendicular to the edge 2. The blade cuts through the hair with what can be best described as a chopping action. There is a tendency for the hair to be displaced and knocked over in front of the moving blade edge, but it becomes cut through since the hair root is held firmly by the skin. A cutting element according to the present invention involves a very different cutting action the principle of which is illustrated in FIG. 2. A tapered slot 5 is defined by a pair of opposed sharpened cutting edges 6 the edges being at an angle of about 5° to each other. The forward end of the slot is open and has a width somewhat greater than the diameter of hairs to be cut, for example a width of around 250 $\mu$m. The rear end of the slot may be completely closed, or could be a very narrow slit. The cutting element is moved across the skin in the direction of the arrow A. When a hair H enters the forward end of the slot 5 and moves relative to the sharpened edges 6 towards the rear end of the slot, the hair contacts the edges which slice into the hair, the depth of slice gradually increasing until the hair is completely severed. A slit of a few microns width may be left between the rear ends of the sharpened edges, but the uncut section of hair will be so thin that it will immediately fracture.

Figure 3:
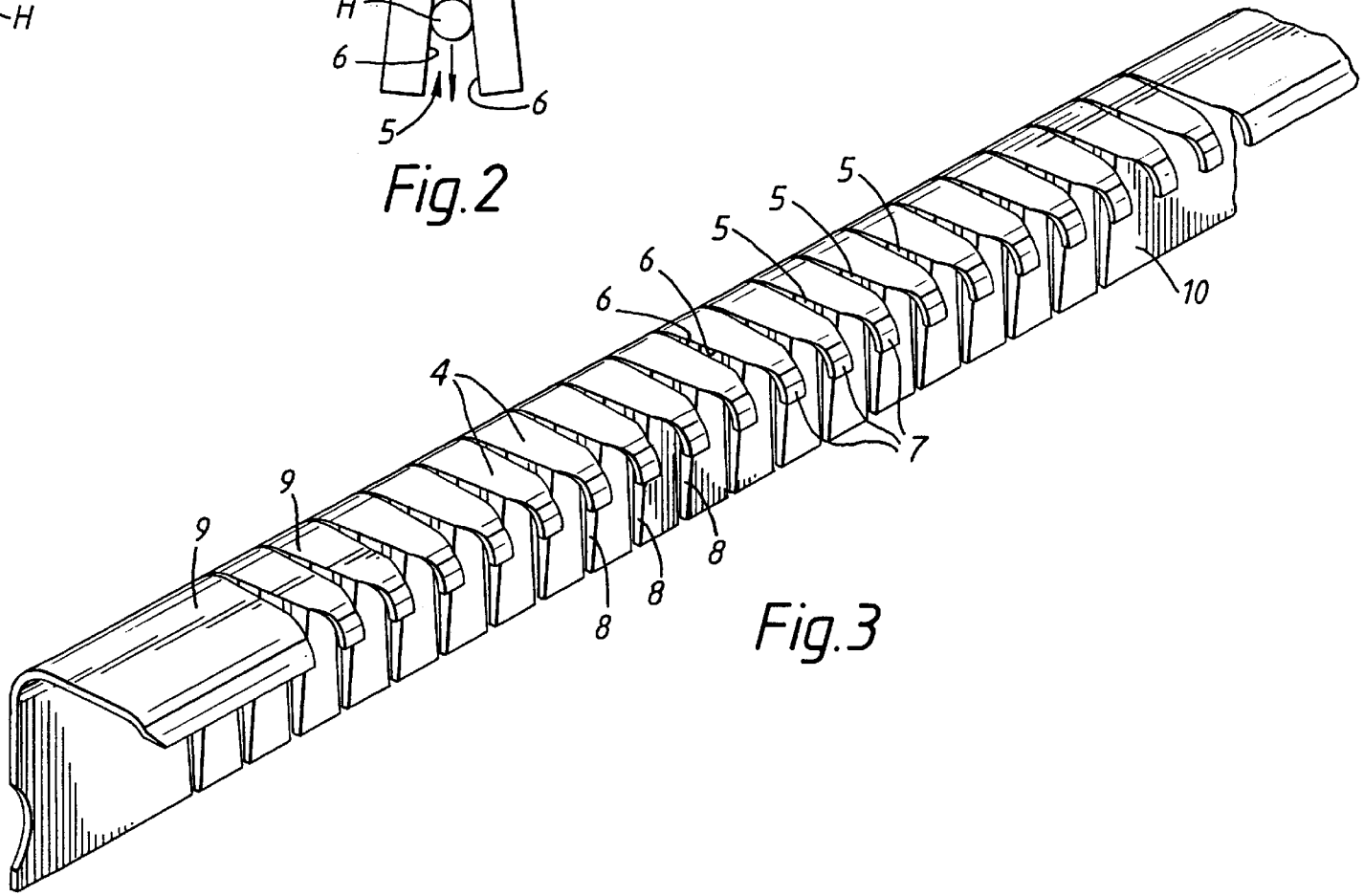
FIG. 3 is an isometric view of a cutting element according to the invention.

A specific embodiment of a cutting element according to the invention is shown in FIG. 3. It comprises an integral metal strip which is initially produced in a flat condition. A series of essentially identical parallel slots 5 are formed in the strip at a uniform pitch, e.g. in the range of 0.5 to 2.0 mm, along the strip. The slots taper from open ends at a forward edge of the strip to closed rear ends. The slots are conveniently produced in such a manner that sharpened edges 6 are simultaneously formed along the sides of the slots. For example a V-shaped grinding wheel can be used to form the slots, the grinding depth gradually diminishing so that initially the grinding wheel breaks through the metal of the strip, but after the closed ends of the slot the grinding wheel leaves only grooves 8 in the underside of the strip. The strip is then bent to form a substantially planar surface 9 for engagement with the skin, in which surface the tapered slots 5 are located, a rounded off front edge section 7 at which the slots are not formed with sharp edges or the sharp edges are removed, and a rear wall portion 10 which serves to stiffen the cutting element. Each of the slots 5 has a length of about 1.8 mm and will act to cut hairs with a slicing action when the cutting element is moved over the skin. The rounded forward portions 7 of the teeth 4 between the slots serve to guide the skin towards the skin engaging surface and away from the forward extremities of the sharpened edges of the slots. The sharp edges, due to the shape of the grinding wheel, are located at the skin engaging surface 9 so that the hairs will be cut as close as possible to the skin.

The edges need not be sharpened all the way to the forward ends of the slots. The width of the slots at the location where the sharpened edges commence is in the range of 50 to 500 $\mu$m, whereas the width of the slots at their forward most ends where the edges may be unsharpened and do not act to sever hairs may be in the range of 50 to 1500 $\mu$m.

Figure 4:
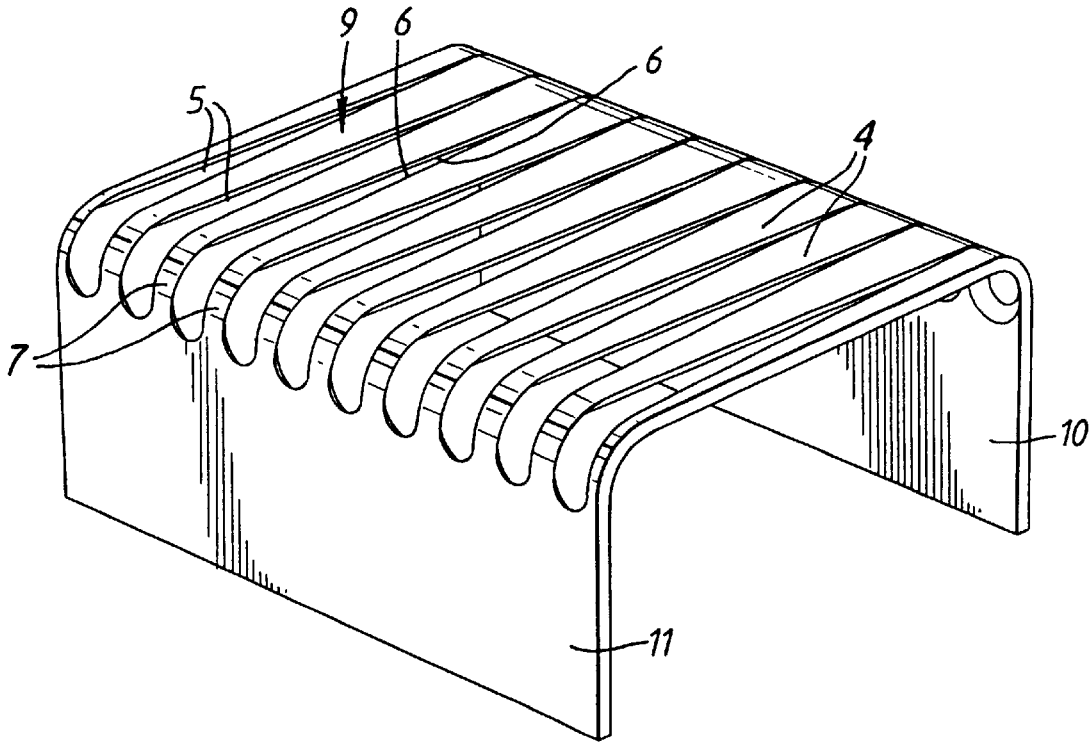
FIG. 4 is an isometric view illustrating another embodiment of a cutting element according to the invention.

A slightly modified cutting element is shown in FIG. 4. The metal strip has a front wall 11 below the rounded sections 7 at the forward ends of the teeth 4 between the slots 5 which gives greater rigidity and provides greater support to resist any tendency for the teeth to deflect laterally when hairs are being cut in the slots.

Figure 5:
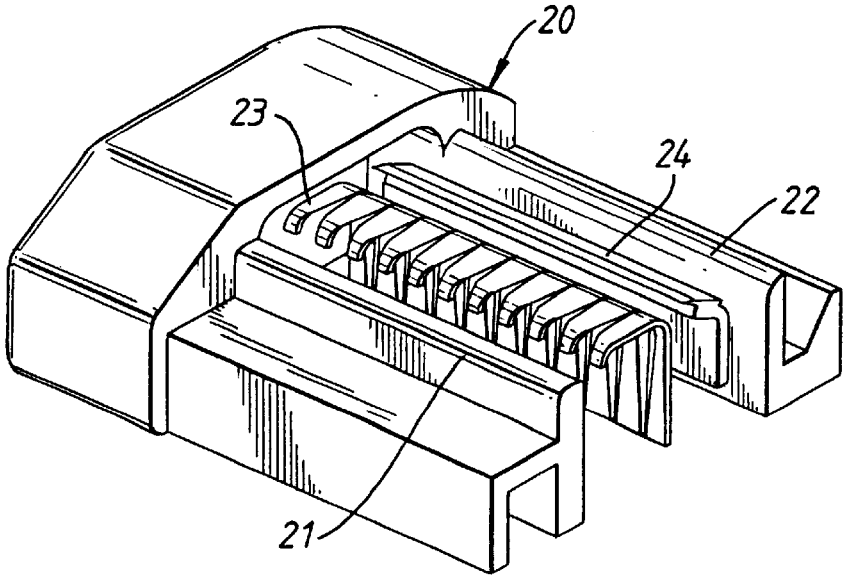
FIGS. 5 to 8 are partial isometric views illustrating respective safety razor blade units incorporating cutting elements as shown in FIG. 3.

In FIG. 5 there is illustrated an end portion of a safety razor blade unit or cartridge comprising a frame 20 providing guard and cap surfaces 21,22, respectively, and two cutting elements mounted in tandem in an opening defined by the frame between the guard and cap surfaces, the leading cutting element 23 being as described above with reference to FIG. 3 and hence in accordance with the invention, whilst the second or trailing cutting element 24 is a conventional blade with a rectilinear cutting edge.

Figure 6:
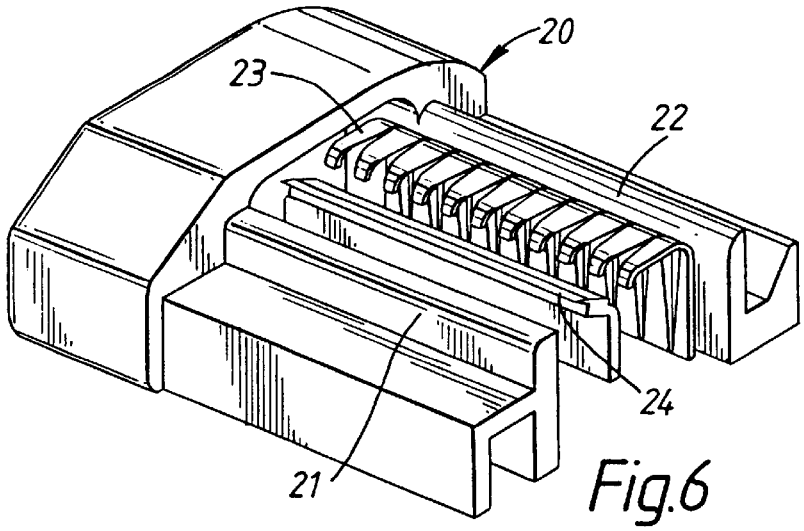

FIG. 6 shows partially a safety razor blade unit which is similar to that of FIG. 5, but differs in that the positions of the cutting elements are reversed so that the conventional blade 24 constitutes the leading cutting element and the cutting element 23 according to this invention is positioned behind the blade 24.

Figure 7:
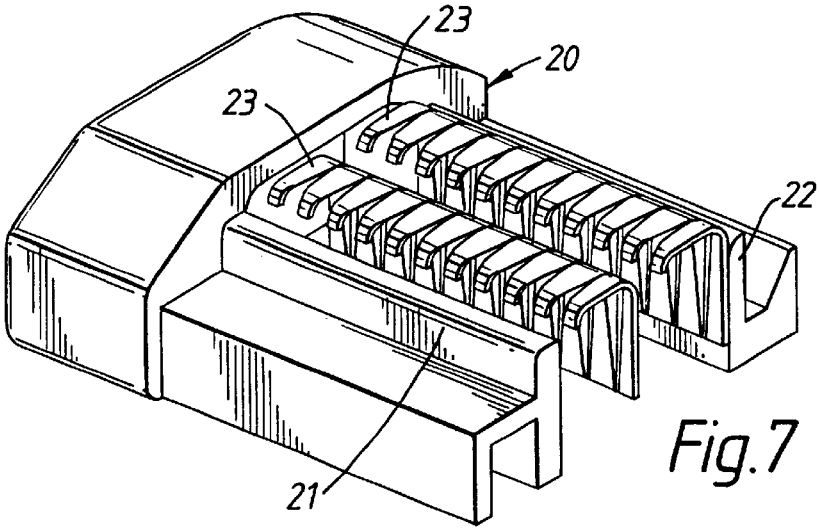

In FIG. 7 there is illustrated a safety razor blade unit with two cutting elements in tandem between the guard and cap surfaces, and both cutting elements 23 being as described with reference to FIG. 3. The slots of the respective cutting elements may be aligned with each other or may be displaced relative to one another longitudinally of the blade unit.

Figure 8:
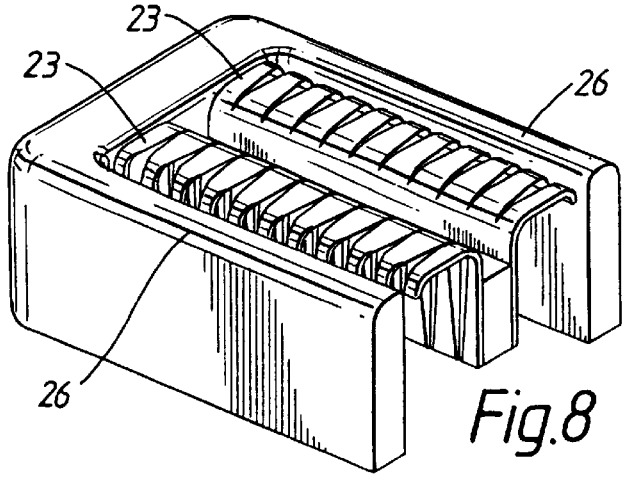

The safety razor blade unit shown in FIG. 8 also has two cutting elements 23 as described with reference to FIG. 3, but in this embodiment they are mounted back-to-back between guard/cap surfaces 26 provided on the frame so that the blade unit can be used by stroking the blade unit to-and-fro while in contact with the surface of the skin being shaved.

The particularly described embodiments are given by way of non-limiting example and other specific forms of cutting element are possible within the scope of the invention as defined by the following claims.

What is claimed is:

1. A cutting element for a safety razor comprising a strip including a plurality of narrow slots arranged side-by-side for receiving hairs to be shaved, each of said slots having an open entrance end facing in the direction of shaving and having a rear end removed from said entrance end along the direction of shaving, and each of said slots having confronting side edges spaced apart by a distance larger than the diameter of a hair to be shaved at the entrance end and being spaced apart by a distance less than the diameter of the hair at the rear end, each of said confronting edges being sharpened for slicing opposite sides of the hairs entering the slot and moving therealong toward the rear end as the cutting element is moved across the skin during shaving, the length of the slot between the entrance and rear ends being several times greater than the distance between the confronting edges at the entrance end.

2. A cutting element according to claim 1, wherein the angle of taper between the slot edges is not greater than 10°.

3. A cutting element according to claim 2, wherein the angle of taper between the slot edges is from 3° to 7°.

4. A cutting element according to claim 1, wherein the sharpened edges have a length along the slots in the range of 1 to 2.5 mm.

5. A cutting element according to any one of claim 1, wherein the width of the slots at the forward end of the sharpened edges is in the range of 50 to 500 $\mu$m.

6. A cutting element according to any one of claim 1, wherein the element is elongated with a series of various slots distributed therealong to extend substantially perpendicular to the length of the element.

7. A cutting element according to claim 6, wherein the slots are positioned along the element at a pitch in the range of 0.5 to 2.0 mm.

8. A cutting element according to claim 1, wherein the slots are formed in a substantially planar cutting element portion defining a skin engaging surface, and the sharpened edges of said slots are located at said skin engaging surface.

9. A cutting element according to claim 1, wherein the cutting element has a forward portion on either side of the forward end of each slot shaped to guide skin away from the sharpened edges.

10. A cutting element according to claim 9, wherein the element has rounded surface portions on each side of the forward end of each slot.

11. A safety razor blade unit including a frame and at least one cutting element mounted on said frame, said cutting element comprising a strip including a plurality of narrow slots arranged side-by-side for receiving hairs to be shaved, each of said slots having an open entrance end facing in the direction of shaving and having a rear end removed from said entrance end along the direction of shaving, and each of said slots having confronting side edges spaced apart by a distance larger than the diameter of a hair to be shaved at the entrance end and being spaced apart by a distance less than the diameter of the hair at the rear end, each of said confronting edges being sharpened for slicing opposite sides of the hairs entering the slot and moving therealong toward the rear end as the cutting element is moved across the skin during shaving, the length of the slot between the entrance and rear ends being several times greater than the distance between the confronting edges at the entrance end.

12. A safety razor including at least one cutting element comprising a strip including a plurality of narrow slots arranged side-by-side for receiving hairs to be shaved, each of said slots having an open entrance end facing in the direction of shaving and having a rear end removed from said entrance end along the direction of shaving, and each of said slots having confronting side edges spaced apart by a distance larger than the diameter of a hair to be shaved at the entrance end and being spaced apart by a distance less than the diameter of the hair at the rear end, each of said confronting edges being sharpened for slicing opposite sides of the hairs entering the slot and moving therealong toward the rear end as the cutting element is moved across the skin during shaving, the length of the slot between the entrance and rear ends being several times greater than the distance between the confronting edges at the entrance end.

13. A safety razor blade unit according to claim 11, which includes two of said cutting elements disposed back-to-back.

14. A safety razor according to claim 12, which includes two of said cutting elements disposed back-to-back.

15. A safety razor blade unit according to claim 11, which includes a plurality of cutting elements positioned with their slots extending in different directions.

16. A safety razor according to claim 12, which includes a plurality of cutting elements positioned with their slots extending in different directions.

* * * * *

UNITED STATES PATENT AND TRADEMARK OFFICE

CERTIFICATE OF CORRECTION

PATENT NO. : 6,176,014 B1
DATED : January 23, 2001
INVENTOR(S) : Richard Garraway It is certified that error appears in the above-identified patent and that said Letters Patent is hereby corrected as shown below:

Column 4, claim 5,
Line 40, delete "any one of".

Column 4, claim 6,
Line 43, delete "any one of".
Line 44, change "various" to -- narrow --.

Signed and Sealed this

Thirteenth Day of November, 2001

*Attest:*

Nicholas P. Godici

*Attesting Officer*

NICHOLAS P. GODICI
*Acting Director of the United States Patent and Trademark Office*